US011205359B2

(12) United States Patent
Li et al.

(10) Patent No.: US 11,205,359 B2
(45) Date of Patent: Dec. 21, 2021

(54) ELECTRICAL LEVEL SHIFTING CHIP AND DISPLAY DEVICE

(71) Applicant: TCL CHINA STAR OPTOELECTRONICS TECHNOLOGY CO., LTD., Shenzhen (CN)

(72) Inventors: Wenfang Li, Shenzhen (CN); Dan Cao, Shenzhen (CN)

( * ) Notice: Subject to any disclaimer, the term of this patent is extended or adjusted under 35 U.S.C. 154(b) by 251 days.

(21) Appl. No.: 16/626,332

(22) PCT Filed: Nov. 22, 2019

(86) PCT No.: PCT/CN2019/120205

§ 371 (c)(1),
(2) Date: Dec. 24, 2019

(87) PCT Pub. No.: WO2021/093000

PCT Pub. Date: May 20, 2021

(65) Prior Publication Data

US 2021/0358353 A1 Nov. 18, 2021

(30) Foreign Application Priority Data

Nov. 13, 2019 (CN) ..... 201911108614.0

(51) Int. Cl.
*G09G 3/00* (2006.01)

(52) U.S. Cl.
CPC ..... *G09G 3/006* (2013.01); *G09G 2310/0289* (2013.01); *G09G 2330/025* (2013.01); *G09G 2330/12* (2013.01)

(58) Field of Classification Search
None
See application file for complete search history.

(56) References Cited

U.S. PATENT DOCUMENTS

| | | | | |
|---|---|---|---|---|
| 8,569,954 | B2 | 10/2013 | Kang | |
| 2008/0180418 | A1 | 7/2008 | Fu | |
| 2013/0286517 | A1* | 10/2013 | Tian | H01L 27/0248 361/56 |
| 2019/0204694 | A1 | 7/2019 | Wang et al. | |

FOREIGN PATENT DOCUMENTS

| | | | |
|---|---|---|---|
| CN | 105448260 | A | 3/2016 |
| CN | 107068092 | A | 8/2017 |
| CN | 108303581 | A | 7/2018 |

* cited by examiner

*Primary Examiner* — Christopher J Kohlman

(57) ABSTRACT

An electrical level shifting chip and a display device are provided. The electrical level shifting chip includes an electrical level shifting module, an overcurrent protecting module, and a controlling module. The control module is configured to detect whether the electrical level shifting chip is in an electrostatic discharge test mode and to disable the overcurrent protecting module when the electrical level shifting chip is in the electrostatic discharge test mode. Avoid the overcurrent protecting module from being disturbed and causing malfunction during an electrostatic discharge test.

20 Claims, 2 Drawing Sheets

ELECTRICAL LEVEL SHIFTING CHIP AND DISPLAY DEVICE

FIELD

The present disclosure relates to display technologies, and more particularly, to an electrical level shifting chip and a display device.

BACKGROUND

Using an array process to directly fabricate a gate scan driving circuit on a thin film transistor array substrate (GOA) instead of an external gate scan driving IC technology can further reduce production cost. In a GOA circuit, it is generally required to access a plurality of clock signals to realize a function of its gate progressive scanning. In prior art, an initial clock signal is usually level-converted by a level shifter IC and output to the GOA circuit of a liquid crystal display panel. In order to prevent the liquid crystal display panel from being burnt out due to a short circuit of the clock signal trace, the prior art level shifter chip generally has an over current protection (OCP) function. However, when an electrostatic discharge (ESD) test is performed, an overcurrent protection module is susceptible to interference and malfunction, and the filter pin signal is reversed, resulting in a black screen of the liquid crystal display panel.

Therefore, issues of existing overcurrent protection module malfunctioning need to be solved.

SUMMARY

In view of the above, the present disclosure provides an electrical level shifting chip and a display device to solve the technical issue of overcurrent protection module malfunctioning.

In order to achieve above-mentioned object of the present disclosure, one embodiment of the disclosure provides an electrical level shifting chip including an electrical level shifting module, an overcurrent protecting module, and a controlling module. The overcurrent protecting module is configured to protect the electrical level shifting module from over current. The controlling module is configured to detect original translation whether the electrical level shifting chip is in an electrostatic discharge test mode and to disable the overcurrent protecting module when the electrical level shifting chip is in the electrostatic discharge test mode.

In one embodiment of the electrical level shifting chip of the disclosure, the controlling module includes a first comparator, a first input end of the first comparator is grounded, a second input end of the first comparator is received a first reference voltage, and an output end of the first comparator is connected to a enable signal input end of the overcurrent protecting module.

In one embodiment of the electrical level shifting chip of the disclosure, the controlling module includes a second comparator, a third comparator, a first current source, a first switch, and a capacitor. A first input end of the second comparator is grounded, a second input end of the second comparator is received a second reference voltage, and an output end of the second comparator is connected to a control end of the first switch to switch the first switch. An input end of the first switch is connected to the first current source, and an output end of the first switch is connected to a first electrode plate of the capacitor. A second electrode plate of the capacitor is grounded. A first input end of the third comparator is connected to the first electrode plate of the capacitor, a second input end of the third comparator is received a third reference voltage, and an output end of the third comparator is connected to the enable signal input end of the overcurrent protecting module.

In one embodiment of the electrical level shifting chip of the disclosure, the first switch is a field effect transistor.

In one embodiment of the electrical level shifting chip of the disclosure, the field effect transistor is an N-type field effect transistor.

In one embodiment of the electrical level shifting chip of the disclosure, a gate of the N-type field effect transistor is connected to the output end of the second comparator, a source of the N-type field effect transistor is connected to the first current source, and a drain of the N-type field effect transistor is connected to the capacitor.

In one embodiment of the electrical level shifting chip of the disclosure, the controlling module is configured to output a high level enable signal when a detecting result of the electrical level shifting chip is in the electrostatic discharge test mode, and the overcurrent protecting module is stopped working when the overcurrent protecting module is received the high level enable signal.

In one embodiment of the electrical level shifting chip of the disclosure, the controlling module is configured to output a low level enable signal when a detecting result of the electrical level shifting chip is in the electrostatic discharge test mode, and the overcurrent protecting module is stopped working when the overcurrent protecting module is received the low level enable signal.

In one embodiment of the electrical level shifting chip of the disclosure, the controlling module is configured to control the overcurrent protecting module to work normally when the electrical level shifting chip is in a non-electrostatic discharge test mode.

In one embodiment of the electrical level shifting chip of the disclosure, the controlling module is outputted no enable signal when the electrical level shifting chip is in the non-electrostatic discharge test mode, and the overcurrent protecting module works normally when the overcurrent protecting module is not received the enable signal.

Furthermore, another embodiment of the disclosure provides a display device including an electrical level shifting chip, a gate driving module, a source driving module, and an array substrate. The electrical level shifting chip includes an electrical level shifting module, an overcurrent protecting module, and a controlling module. The overcurrent protecting module is configured to protect the electrical level shifting module from over current. The controlling module is configured to detect whether the electrical level shifting chip is in an electrostatic discharge test mode and to disable the overcurrent protecting module when the electrical level shifting chip is in the electrostatic discharge test mode.

In one embodiment of the display device of the disclosure, the controlling module includes a first comparator, a first input end of the first comparator is grounded, a second input end of the first comparator is received a first reference voltage, and an output end of the first comparator is connected to a enable signal input end of the overcurrent protecting module.

In one embodiment of the display device of the disclosure, the controlling module includes a second comparator, a third comparator, a first current source, a first switch, and a capacitor. A first input end of the second comparator is grounded, a second input end of the second comparator is received a second reference voltage, and an output end of the second comparator is connected to a control end of the first switch to switch the first switch. An input end of the first switch is connected to the first current source, and an output end of the first switch is connected to a first electrode plate of the capacitor. A second electrode plate of the capacitor is grounded. A first input end of the third comparator is connected to the first electrode plate of the capacitor, a second input end of the third comparator is received a third reference voltage, and an output end of the third comparator is connected to the enable signal input end of the overcurrent protecting module.

In one embodiment of the display device of the disclosure, the first switch is a field effect transistor.

In one embodiment of the display device of the disclosure, the field effect transistor is a N-type field effect transistor.

In one embodiment of the display device of the disclosure, a gate of the N-type field effect transistor is connected to the output end of the second comparator, a source of the N-type field effect transistor is connected to the first current source, and a drain of the N-type field effect transistor is connected to the capacitor.

In one embodiment of the display device of the disclosure, the controlling module is configured to output a high level enable signal when a detecting result of the electrical level shifting chip is in the electrostatic discharge test mode, and the overcurrent protecting module is stopped working when the overcurrent protecting module is received the high level enable signal.

In one embodiment of the display device of the disclosure, the controlling module is configured to output a low level enable signal when a detecting result of the electrical level shifting chip is in the electrostatic discharge test mode, and the overcurrent protecting module is stopped working when the overcurrent protecting module is received the low level enable signal.

In one embodiment of the display device of the disclosure, the controlling module is configured to control the overcurrent protecting module to work normally when the electrical level shifting chip is in a non-electrostatic discharge test mode.

In one embodiment of the display device of the disclosure, the controlling module is outputted no enable signal when the electrical level shifting chip is in the non-electrostatic discharge test mode, and the overcurrent protecting module works normally when the overcurrent protecting module is not received the enable signal.

In comparison with prior art, the electrical level shifting chip and the display device of the disclosure provide the controlling module to detect whether the electrical level shifting chip is in an electrostatic discharge test mode and to disable the overcurrent protecting module when the electrical level shifting chip is in the electrostatic discharge test mode to avoid the overcurrent protecting module from being disturbed and causing malfunction during an electrostatic discharge test.

BRIEF DESCRIPTION OF DRAWINGS

In order to more clearly illustrate the embodiments of the present application or the technical solutions in the prior art, the drawings used in the embodiments will be briefly described below. The drawings in the following description are only partial embodiments of the present application, and those skilled in the art can obtain other drawings according to the drawings without any creative work.

DETAILED DESCRIPTION

The following description of the embodiments is provided by reference to the drawings and illustrates the specific embodiments of the present disclosure. Directional terms mentioned in the present disclosure, such as "up," "down," "top," "bottom," "forward," "backward," "left," "right," "inside," "outside," "side," "peripheral," "central," "horizontal," "peripheral," "vertical," "longitudinal," "axial," "radial," "uppermost" or "lowermost," etc., are merely indicated the direction of the drawings. Therefore, the directional terms are used for illustrating and understanding of the application rather than limiting thereof.

The present disclosure provides an electrical level shifting chip and a display device to solve the technical issue of overcurrent protection module malfunctioning.

Figure 1:
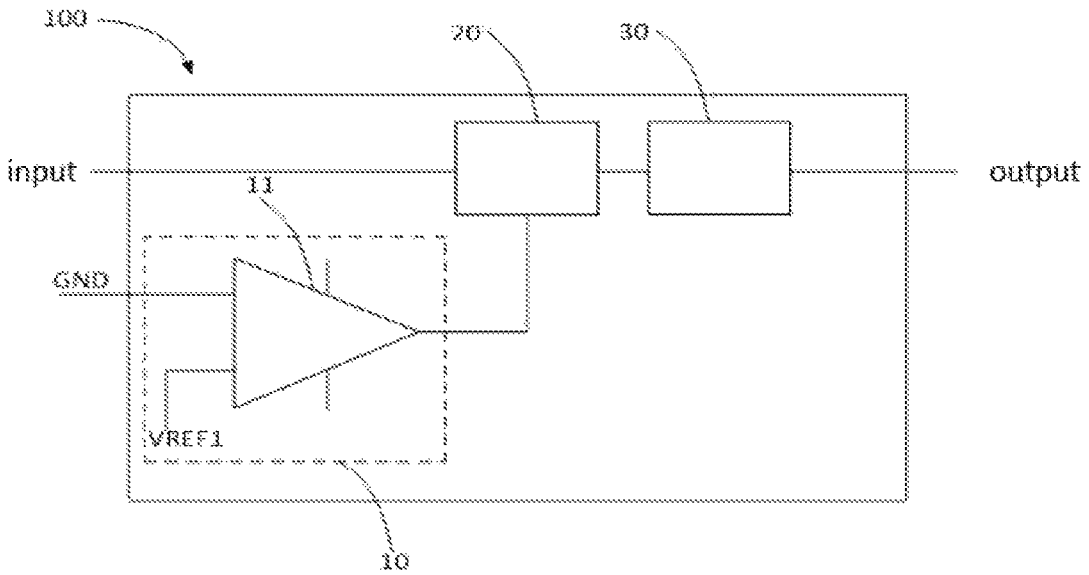
FIG. 1 is a schematic view of a first circuit of an electrical level shifting chip according to an embodiment of the present disclosure.
Figure 2:
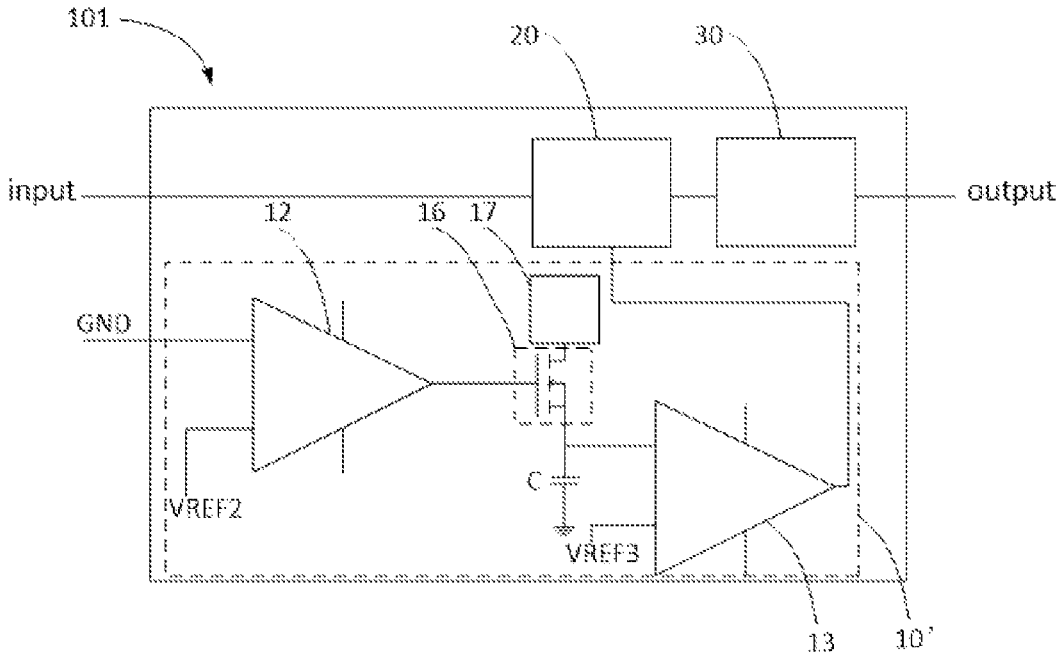
FIG. 2 is a schematic view of a second circuit of an electrical level shifting chip according to an embodiment of the present disclosure.

Referring to FIG. 1, one embodiment of the disclosure provides an electrical level shifting chip 100 including an electrical level shifting module 30, an overcurrent protecting module 20, and a controlling module 10. The overcurrent protecting module 20 is configured to protect the electrical level shifting module 30 from over current. The controlling module 10 is configured to detect whether the electrical level shifting chip is in an electrostatic discharge test mode and to disable the overcurrent protecting module 20 when the electrical level shifting chip is in the electrostatic discharge test mode.

In detail, in one embodiment of the electrical level shifting chip of the disclosure, the controlling module 10 is configured to output a high level enable signal when a detecting result of the electrical level shifting chip is in the electrostatic discharge test mode, and the overcurrent protecting module 20 is stopped working when the overcurrent protecting module is received the high level enable signal.

In detail, the electrical level shifting module works normally when the overcurrent protecting module 20 stops working.

In one embodiment of the electrical level shifting chip of the disclosure, the controlling module 10 is configured to control the overcurrent protecting module 20 to work normally when the electrical level shifting chip is in a non-electrostatic discharge test mode.

In detail, the controlling module 10 is outputted no enable signal when the electrical level shifting chip is in the non-electrostatic discharge test mode, and the overcurrent protecting module works normally when the overcurrent protecting module 20 is not received the enable signal.

Referring to FIG. 1, in one embodiment of the electrical level shifting chip of the disclosure, the controlling module 10 includes a first comparator 11, a first input end of the first comparator 11 is grounded GND, a second input end of the first comparator 11 is received a first reference voltage VREF1, and an output end of the first comparator 11 is connected to a enable signal input end of the overcurrent protecting module 20.

In detail, a comparator is an electronic component that outputs different voltage results at an output end by comparing the magnitude of the current or voltage at two input ends. The comparator is often used in an analog-to-digital conversion circuit.

In one embodiment of the disclosure, a detection process of the controlling module 10 is described as following. When the electrical level shifting chip is detected to be in the electrostatic discharge test mode, the ground GND will be subjected a greater disturbance to have a greater voltage disturbance. When a voltage of the ground GND is greater than the first reference voltage VREF1, the output end of the first comparator 11 will output the high level enable signal to the overcurrent protecting module 20. When the overcurrent protecting module 20 receives the high level enable signal, the overcurrent protecting module 20 stops working to prevent from malfunction in the electrostatic discharge test. When the electrical level shifting chip is detected to be in the non-electrostatic discharge test mode, the voltage of the ground GND is less than the first reference voltage VREF1. The first comparator 11 outputs no enable signal. The overcurrent protecting module 20 receives no enable signal and works normally.

In detail, the overcurrent protecting module 20 stops working means that the overcurrent protecting function of the overcurrent protecting module 20 is cancel, that is, no matter existing over current or not, the overcurrent protecting module 20 will not work, and the electrical level shifting module works normally. The overcurrent protecting module 20 works normally means that when there is over current coming, the overcurrent protecting module 20 will be started to control the electrical level shifting module to stop working. When there is no over current, the overcurrent protecting module 20 will not be active, and the electrical level shifting module will work normally.

In one embodiment of the electrical level shifting chip 101 of the disclosure includes the electrical level shifting module 30, the overcurrent protecting module 20, and a controlling module 10'. The controlling module 10' includes a second comparator 12, a third comparator 13, a first current source 17, a first switch 16, and a capacitor C. A first input end of the second comparator 12 is grounded GND, a second input end of the second comparator 12 is received a second reference voltage VREF2, and an output end of the second comparator 12 is connected to a control end of the first switch 16 to switch the first switch 16. An input end of the first switch 16 is connected to the first current source 17, and an output end of the first switch 16 is connected to a first electrode plate of the capacitor C. A second electrode plate of the capacitor C is grounded. A first input end of the third comparator 13 is connected to the first electrode plate of the capacitor C, a second input end of the third comparator 13 is received a third reference voltage VREF3, and an output end of the third comparator 13 is connected to the enable signal input end of the overcurrent protecting module 20.

In detail, the first switch 16 is a field effect transistor. A gate of the field effect transistor is connected to the output end of the second comparator 12, a source of the field effect transistor is connected to the first current source 17, and a drain of the field effect transistor is connected to the first electrode plate of the capacitor C.

In detail, the field effect transistor is an N-type field effect transistor or a P-type field effect transistor. The first switch 16 is N-type field effect transistor. But the disclosure is not limited thereto, and those skilled in the art can configure the second comparator 12 suitable for using a P-type field effect transistor in accordance with the spirit of the present application.

In detail, in the N-type field effect transistor, when the gate voltage is greater than a certain value, the source and the drain are electrical conduction; when the gate voltage is less than a certain value, the source and the drain are electrical conduction.

In one embodiment of the disclosure, a detection process of the controlling module 10' is described as following. When the electrical level shifting chip is detected to be in the electrostatic discharge test mode, the ground GND will be subjected a greater disturbance to have a greater voltage disturbance. When a voltage of the ground GND is greater than the second reference voltage VREF2, the output end of the second comparator 12 will output the high level enable signal to the gate of the first switch 16. When the gate of the first switch 16 receives the high level enable signal, the source and the drain are electrical conduction. Current of the first current source 17 flows from the source of the first switch 16 to the drain of the first switch 16 and to the first electrode plate of the capacitor C to charge the capacitor C. The first input end of the third comparator 13 is connected to the first electrode plate of the capacitor C. A voltage of the first input end increases as the charging time of the capacitor C increase. When the voltage of the first input end is greater than the third reference voltage VREF3, the output end of the third comparator 13 provides high level enable signal to the overcurrent protecting module 20. The overcurrent protecting module 20 stops working when receiving the high level enable signal. When the electrical level shifting chip is detected to be in the non-electrostatic discharge test mode, the ground GND is subjected no disturbance of the electrostatic discharge test, and the voltage of the ground GND is less than the second reference voltage VREF2. The second comparator 12 outputs no enable signal. The first switch 16 is not electrical conduction. The first current source 17 do not charge the capacitor C. the voltage of the first input end of the third comparator 13 is less third reference voltage VREF3 of the second input end of the third comparator 13. The output end of the third comparator 13 output no enable signal to the overcurrent protecting module 20. The overcurrent protecting module 20 works normally.

In one embodiment of the disclosure, the overcurrent protecting module can also be triggered to stop working by a low level enable signal. The disclosure does not limit this. In detail, when the electrical level shifting chip is detected to be in the electrostatic discharge test mode by the controlling module, the overcurrent protecting module receives the low level enable signal and stops working. For the detail detection work process, please refer to the description of the above embodiment, which will not be repeated here.

Furthermore, another embodiment of the disclosure provides a display device including an electrical level shifting chip, a gate driving module, a source driving module, and an array substrate. The electrical level shifting chip includes an electrical level shifting module, an overcurrent protecting module, and a controlling module. The overcurrent protecting module is configured to protect the electrical level shifting module from over current. The controlling module is configured to detect whether the electrical level shifting chip is in an electrostatic discharge test mode and to disable the overcurrent protecting module when the electrical level shifting chip is in the electrostatic discharge test mode.

In detail, the controlling module includes a first comparator, a first input end of the first comparator is grounded, a second input end of the first comparator is received a first reference voltage, and an output end of first the first comparator is connected to a enable signal input end of the overcurrent protecting module.

In detail, the controlling module includes a second comparator, a third comparator, a first current source, a first switch, and a capacitor. A first input end of the second comparator is grounded, a second input end of the second comparator is received a second reference voltage, and an output end of the second comparator is connected to a control end of the first switch to switch the first switch. An input end of the first switch is connected to the first current source, and an output end of the first switch is connected to a first electrode plate of the capacitor. A second electrode plate of the capacitor is grounded. A first input end of the third comparator is connected to the first electrode plate of the capacitor, a second input end of the third comparator is received a third reference voltage, and an output end of the third comparator is connected to the enable signal input end of the overcurrent protecting module.

In one embodiment of the display device of the disclosure, the first switch is a field effect transistor.

In one embodiment of the display device of the disclosure, the field effect transistor is a N-type field effect transistor.

In one embodiment of the display device of the disclosure, a gate of the N-type field effect transistor is connected to the output end of the second comparator, a source of the N-type field effect transistor is connected to the first current source, and a drain of the N-type field effect transistor is connected to the capacitor.

In one embodiment of the display device of the disclosure, the controlling module is configured to output a high level enable signal when a detecting result of the electrical level shifting chip is in the electrostatic discharge test mode, and the overcurrent protecting module is stopped working when the overcurrent protecting module is received the high level enable signal.

In one embodiment of the display device of the disclosure, the controlling module is configured to output a low level enable signal when a detecting result of the electrical level shifting chip is in the electrostatic discharge test mode, and the overcurrent protecting module is stopped working when the overcurrent protecting module is received the low level enable signal.

In one embodiment of the display device of the disclosure, the controlling module is configured to control the overcurrent protecting module to work normally when the electrical level shifting chip is in a non-electrostatic discharge test mode.

In one embodiment of the display device of the disclosure, the controlling module is outputted no enable signal when the electrical level shifting chip is in the non-electrostatic discharge test mode, and the overcurrent protecting module works normally when the overcurrent protecting module is not received the enable signal.

Figure 3:
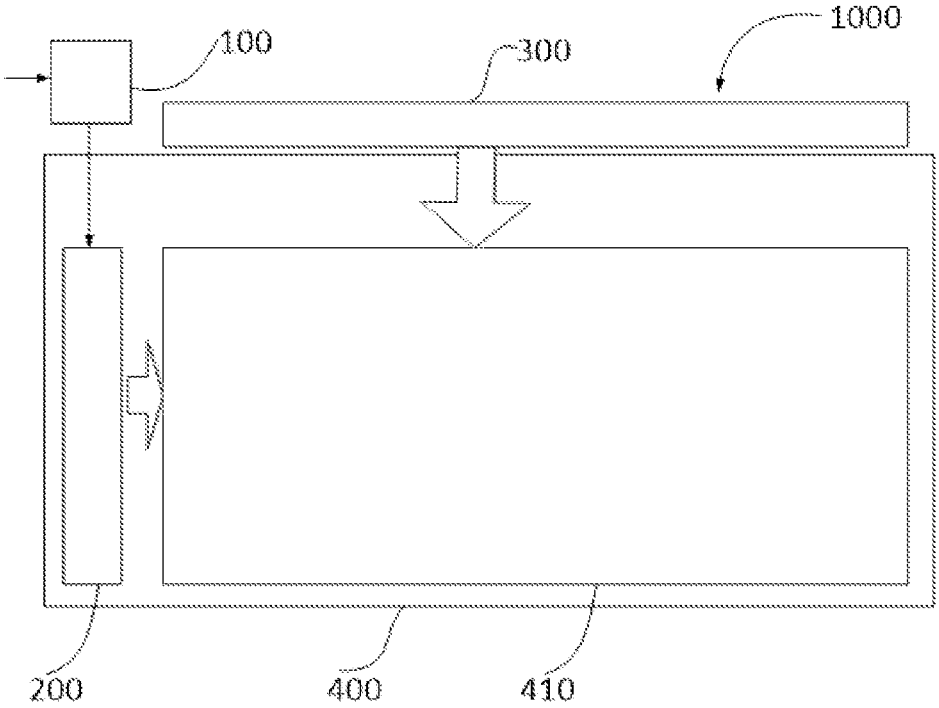
FIG. 3 is a schematic top view of a structure of a display device according to another embodiment of the present disclosure.

In detail, referring to FIG. 3, the display device 1000 includes the electrical level shifting chip 100, the gate driving module 200, the source driving module 300, and the array substrate 400. The source driving module 300 is disposed at a outside edge of the array substrate 400. The gate driving module 200 is disposed on the array substrate 400. The gate driving module 200 and the source driving module 300 are configured to control the array substrate to display. The electrical level shifting chip 100 is configured to provide input electrical level of the gate driving module 200.

In detail, a display region 410 of the array substrate 400 is provided with a plurality of pixels. The gate driving module 200 and the source driving module 300 are configured to control the plurality of pixels to display.

In comparison with prior art, the electrical level shifting chip and the display device of the disclosure provide the controlling module to detect whether the electrical level shifting chip is in an electrostatic discharge test mode and to disable the overcurrent protecting module when the electrical level shifting chip is in the electrostatic discharge test mode to avoid the overcurrent protecting module from being disturbed and causing malfunction during an electrostatic discharge test.

The present disclosure of a display panel, a method of manufacturing the same and a terminal has been described by the above embodiments, but the embodiments are merely examples for implementing the present disclosure. It must be noted that the embodiments do not limit the scope of the invention. In contrast, modifications and equivalent arrangements are intended to be included within the scope of the invention.

What is claimed is:

1. An electrical level shifting chip, comprising:

an electrical level shifting module;

an overcurrent protecting module configured to protect the electrical level shifting module from over current; and a controlling module configured to detect whether the electrical level shifting chip is in an electrostatic discharge test mode and to disable the overcurrent protecting module when the electrical level shifting chip is in the electrostatic discharge test mode.

2. The electrical level shifting chip according to claim 1, wherein the controlling module comprises a first comparator, a first input end of the first comparator is grounded, a second input end of the first comparator is received a first reference voltage, and an output end of the first comparator is connected to a enable signal input end of the overcurrent protecting module.

3. The electrical level shifting chip according to claim 1, wherein the controlling module comprises a second comparator, a third comparator, a first current source, a first switch, and a capacitor;

wherein a first input end of the second comparator is grounded, a second input end of the second comparator is received a second reference voltage, and an output end of the second comparator is connected to a control end of the first switch to switch the first switch;

wherein an input end of the first switch is connected to the first current source, and an output end of the first switch is connected to a first electrode plate of the capacitor;

wherein a second electrode plate of the capacitor is grounded; and wherein a first input end of the third comparator is connected to the first electrode plate of the capacitor, a second input end of the third comparator is received a third reference voltage, and an output end of the third comparator is connected to the enable signal input end of the overcurrent protecting module.

4. The electrical level shifting chip according to claim 3, wherein the first switch is a field effect transistor.

5. The electrical level shifting chip according to claim 4, wherein the field effect transistor is a N-type field effect transistor.

6. The electrical level shifting chip according to claim 5, wherein a gate of the N-type field effect transistor is connected to the output end of the second comparator, a source of the N-type field effect transistor is connected to the first current source, and a drain of the N-type field effect transistor is connected to the capacitor.

7. The electrical level shifting chip according to claim 1, wherein the controlling module is configured to output a high level enable signal when a detecting result of the electrical level shifting chip is in the electrostatic discharge test mode, and the overcurrent protecting module is stopped working when the overcurrent protecting module is received the high level enable signal.

8. The electrical level shifting chip according to claim 1, wherein the controlling module is configured to output a low level enable signal when a detecting result of the electrical level shifting chip is in the electrostatic discharge test mode, and the overcurrent protecting module is stopped working when the overcurrent protecting module is received the low level enable signal.

9. The electrical level shifting chip according to claim 1, wherein the controlling module is configured to control the overcurrent protecting module to work normally when the electrical level shifting chip is in a non-electrostatic discharge test mode.

10. The electrical level shifting chip according to claim 9, wherein the controlling module is outputted no enable signal when the electrical level shifting chip is in the non-electrostatic discharge test mode, and the overcurrent protecting module works normally when the overcurrent protecting module is not received the enable signal.

11. A display device comprising an electrical level shifting chip, a gate driving module, a source driving module, and an array substrate, wherein the electrical level shifting chip comprises:

an electrical level shifting module;

an overcurrent protecting module configured to protect the electrical level shifting module from over current; and a controlling module configured to detect whether the electrical level shifting chip is in an electrostatic discharge test mode and to disable the overcurrent protecting module when the electrical level shifting chip is in the electrostatic discharge test mode.

12. The display device according to claim 11, wherein the controlling module comprises a first comparator, a first input end of the first comparator is grounded, a second input end of the first comparator is received a first reference voltage, and an output end of the first comparator is connected to a enable signal input end of the overcurrent protecting module.

13. The display device according to claim 11, wherein the controlling module comprises a second comparator, a third comparator, a first current source, a first switch, and a capacitor;

wherein a first input end of the second comparator is grounded, a second input end of the second comparator is received a second reference voltage, and an output end of the second comparator is connected to a control end of the first switch to switch the first switch;

wherein an input end of the first switch is connected to the first current source, and an output end of the first switch is connected to a first electrode plate of the capacitor;

wherein a second electrode plate of the capacitor is grounded; and wherein a first input end of the third comparator is connected to the first electrode plate of the capacitor, a second input end of the third comparator is received a third reference voltage, and an output end of the third comparator is connected to the enable signal input end of the overcurrent protecting module.

14. The display device according to claim 13, wherein the first switch is a field effect transistor.

15. The display device according to claim 14, wherein the field effect transistor is a N-type field effect transistor.

16. The display device according to claim 15, wherein a gate of the N-type field effect transistor is connected to the output end of the second comparator, a source of the N-type field effect transistor is connected to the first current source, and a drain of the N-type field effect transistor is connected to the capacitor.

17. The display device according to claim 11, wherein the controlling module is configured to output a high level enable signal when a detecting result of the electrical level shifting chip is in the electrostatic discharge test mode, and the overcurrent protecting module is stopped working when the overcurrent protecting module is received the high level enable signal.

18. The display device according to claim 11, wherein the controlling module is configured to output a low level enable signal when a detecting result of the electrical level shifting chip is in the electrostatic discharge test mode, and the overcurrent protecting module is stopped working when the overcurrent protecting module is received the low level enable signal.

19. The display device according to claim 11, wherein the controlling module is configured to control the overcurrent protecting module to work normally when the electrical level shifting chip is in a non-electrostatic discharge test mode.

20. The display device according to claim 19, wherein the controlling module is outputted no enable signal when the electrical level shifting chip is in the non-electrostatic discharge test mode, and the overcurrent protecting module works normally when the overcurrent protecting module is not received the enable signal.

* * * * *